US012359526B2

(12) United States Patent
Eriksen

(10) Patent No.: US 12,359,526 B2
(45) Date of Patent: Jul. 15, 2025

(54) BREAKING OBJECT FOR A FRANGIBLE PLUG

(71) Applicant: TCO AS, Indre Arna (NO)

(72) Inventor: Tommy Eriksen, Yven (NO)

(73) Assignee: TCO AS, Indre Arna (NO)

( * ) Notice: Subject to any disclaimer, the term of this patent is extended or adjusted under 35 U.S.C. 154(b) by 0 days.

(21) Appl. No.: 18/061,666

(22) Filed: Dec. 5, 2022

(65) Prior Publication Data

US 2023/0193718 A1 Jun. 22, 2023

(30) Foreign Application Priority Data

Dec. 20, 2021 (NO) ..... 20211548

(51) Int. Cl.
*E21B 33/12* (2006.01)

(52) U.S. Cl.
CPC ..... *E21B 33/1208* (2013.01)

(58) Field of Classification Search
CPC ..... E21B 33/1208
See application file for complete search history.

(56) References Cited

U.S. PATENT DOCUMENTS

| | | | | |
|---|---|---|---|---|
| 3,434,539 | A * | 3/1969 | Merritt | E21B 33/14 15/104.061 |
| 2019/0017345 | A1 | 1/2019 | Brandsdal | |
| 2021/0140272 | A1* | 5/2021 | Chen | E21B 33/1294 |
| 2021/0262316 | A1* | 8/2021 | Brandsdal | E21B 33/1208 |

* cited by examiner

*Primary Examiner* — Dany E Akakpo
(74) *Attorney, Agent, or Firm* — Flener IP & Business Law; Zareefa Flener; Yongae Jun

(57) ABSTRACT

A plug assembly including a breaker object and a plug, having a first position in which the breaker object is not in contact with the plug and a second position where the breaker object is in contact with the plug, wherein the movement from the first position to the second position initiated by pressure applied to the plug, wherein: the breaker object includes an impact surface where the impact surface is the projection of the plug surface onto the breaker object, and the impact surface includes an impact point wherein: the impact point is the portion of the plug which makes contact with the breaker object when the plug assembly is in the second position; and the impact surface has the cross sectional shape of a portion of a conic section.

15 Claims, 17 Drawing Sheets

BREAKING OBJECT FOR A FRANGIBLE PLUG

CROSS REFERENCES TO PREVIOUS APPLICATIONS

The present application claims priority to Norwegian application number NO20211548 filed Dec. 20, 2021; hereby incorporated by reference herein in its entirety.

FIELD OF INVENTION

The invention is in the field of breaker object to break a frangible plug. More specifically it relates to the specific shape of the breaker object in order to maximize the force applied to the point of impact with a plug. Further it relates to a plug tubular which contains such a breaker object.

BACKGROUND

During the drilling, testing, completion, fracking, production, and abandonment stages of hydrocarbon wells there are many uses for plugs assemblies that create a fluid barrier in the well. Some of these uses are not permanent such as plug and abandonment, but rather temporary, where it is desired to re-establish fluid flow at a later stage. Some examples of such temporary uses of plugs are for flotation, well testing during completion, packer setting and fluid loss devices.

As the well is completed, the integrity of the casing and production tubing is tested to make sure it will not leak during the different conditions expected during oil and gas production. It is then necessary to be able to isolate sections of the well and test them separately. By installing a plug assembly, it is possible to do such testing, and then the plug assembly must be opened or removed before production.

Plug assemblies can also be used as a barrier in the production tubing allowing it to be pressured up when a packer is to be set in order to seal the annulus between the production tubing and casing. It is necessary to open or remove the plug assembly later. Plug assemblies can comprise a plug made of a frangible material. The destruction of this plug allows for the fluid connection through the plug assembly to occur.

Frangible materials such as glass or ceramics have the advantage of being relatively insensitive to pressure, temperature, and chemical corrosion, yet by their frangible nature they are relatively easy to destroy when used as the fluid blocking part of plug assemblies. Glass in particular can be made to break into very small pieces that will not pose a problem in most wells. Frangible materials therefore allow for additional ways of opening the plug assembly, such as constructing the plug assembly with small amounts of explosives that will crush or shatter a glass disc, and open the plug assembly, but not damage the production tubing or casing the plug assembly is installed in. However, when using explosives there is always a risk of explosives or parts thereof remaining undetonated in the well, and the transport and handling during installation of plugs fitted with explosives is complicated as many safety-related conditions must be taken into consideration. Breaking frangible discs in plug assemblies without using explosives is therefore advantageous. The plug itself is usually broken on a breaker object that is part of the plug assembly.

The breaker will then make contact with the frangible disc on a relatively small area, the disc impact surface. Frangible materials such as glass and ceramics can be designed to withstand the high pressures found in hydrocarbon wells, but if exposed to impact on only a very small area they will typically shatter, and this property of breaking under a large point pressure load is taken advantage of by employing a breaker with a relatively small impact area.

Relative movement is then also required, i.e., the breaker must move relative to the plug. This can be achieved by either the plug or breaker moving towards the other, depending on what kind of frangible disc breaking system is employed. Different systems have been developed to achieve this, including use of electrical signals and hydraulic fluids, and pressure. Since it is possible to control how much pressure is applied to the plug assembly and plug therein directly from the surface, using this pressure directly to break the plug is possible. This is an elegant and simple solution, as it does not require signals of any kind to be routed from the surface to the plug assembly, one simply applies pressure from the wellhead and this in turn mechanically actuates movement of the breaker onto the disc impact surface. This pressure from the wellhead is then often to some extent countered by the pressure from downhole, i.e., from the hydrocarbon formation. The specific pressure that is then needed to open a given plug assembly is then the pressure differential between the pressures applied form both downhole and uphole. It is also possible to design a plug assembly to activate based upon an absolute pressure.

There should not be a possibility of a partial opening of the plug, i.e., the system should preferably only allow for the plug to be fully intact or fully broken, not partially broken. If partially broken, it would not be possible to open fully with pressure from above since a partially open plug assembly could not be pressurized, so different means to open it fully would have to be used.

The inner diameter of the tubing the plug assembly is installed in should preferably be fully restored upon opening of the plug assembly, i.e., the plug assembly should not have a smaller inner diameter than the inner diameter below and above the plug assembly. This allows for a nonrestricted fluid flow past the opened plug assembly, and for many applications after opening of the plug assembly it is required in order to pass various tools past the plug assembly.

Traditional breaker objects include a knives blade, a point such as a spike, or stud. These have problems in either a delayed breakage (particularly for knives) or the tight tolerances required in angles and positions in which a pin or stud must be installed. Knifes usually flex as they cut or slice at a side/line, so they don't hit on a point and if they flex too much they may snap. Pins or pegs may snap too if too if too much pressure is applied from the side, as they are usually thin. Studs require a very careful alignment, because if the angle is not just right you get too big of a contact area with the frangible plug. In the event that the plug or breaker is traveling very fast due to a large pressure differential, it is possible for a misaligned breaker object to not completely break the glass; or in the worst case not break it at all. This requires very expensive down time in order to correct by spearing or milling the plug open etc.

Advantages of the Present Invention

As disclosed above, breaker objects should preferably be able to effectively break a plug in multiple positions. This is best achieved by concentrating the force into as small of an area as possible. A point contact is best for achieving this.

It is also an advantage if the point contact can be made regardless of the exact orientation of the breaker object. This allows for a breaker object to be assembled in the plug assembly without high tolerances as to the exact position or angle of it.

This is achieved by the present invention by shaping the end of the breaker object as a conical section such as an ellipse (including a circle) or a parabola.

Mathematics of Curved Surfaces

The invention relates to shapes of the surface of the breaker object in order to form a point contact surface for the frangible plug to break upon. This is achieved by the curve of the surface of the breaker object having a particular shape. In order to define the invention, we provide a brief discussion of the mathematics of curved surfaces.

There are three shapes which are referred to as "conical shapes" which are of importance to this invention. A conical shape is the result of different plane slices (at different angles) through two cones stacked on top of each other with their points touching.

The formula of a unit circle is:

$$x^2+y^2=1$$

The formula of an ellipse is:

$$x^2/a^2+y^2/b^2=1$$

Note that the unit circle is an example of an ellipse where a=b. Thus, a circle is a special ellipse. Finally, one of the formulas for a parabola is:

$$y=x^2$$

These are easily generalized to three dimensions as a sphere, an ellipsoid, and a paraboloid. What is important about these shapes is that a line of any angle in contact with one of these shapes will only have a single point of intersection. In 3 dimensions, a sphere will have a single point of contact, but an ellipsoid or paraboloid may have a single point or contact or a single line of contact, depending upon the exact shape and orientation. A single point of contact is preferred in order for the breaker to contact as small of an area on the frangible disc as possible.

This is leveraged in the invention by shaping the portion of the breaker object that makes contact with the plug surface as a shape which is a portion of an ellipse (including a circle) or a parabola.

SHORT SUMMARY OF THE INVENTION

The plug assembly in accordance with the present invention is characterized by comprising a breaker object and a plug, having a first position in which the breaker object is not in contact with the plug and a second position where the breaker object is in contact with the plug, wherein the movement from the first position to the second position initiated by pressure applied to the plug, wherein:

- the breaker object comprises an impact surface, where the impact surface is the projection of the plug surface onto the breaker object,
- the impact surface comprises an impact point wherein:
  - the impact point is the portion of the plug which makes contact with the breaker object when the plug assembly is in the second position; and
  - the impact surface has the cross-sectional shape of a portion of a conic section.

In accordance with a preferred embodiment of the plug assembly of the present invention the impact surface has a cross sectional shape of a portion of a circle or an ellipse or a parabola.

In accordance with another preferred embodiment of the plug assembly of the present invention the breaker object is a sphere or hemisphere.

In accordance with another preferred embodiment of the plug assembly of the present invention the breaker object is a pin comprising an elongated body with a distal end, wherein the distal end has a cross sectional shape of a conic section. More preferably the pin is at an angle.

In accordance with another preferred embodiment of the plug assembly of the present invention the breaker object is arranged in a breaker holder. Preferably the breaker object is fixed in the breaker holder.

In accordance with another preferred embodiment of the plug assembly of the present invention it further comprises a breaker assembly, wherein a breaker holder is arranged on a breaker assembly and the breaker object is arranged in a breaker holder. Preferably the breaker object is loose in the breaker holder.

In accordance with another preferred embodiment of the plug assembly of the present invention the impact point is contained on an impact subsurface, the impact subsurface bounded by a first subsurface edge and a second subsurface edge, wherein:

- the first subsurface edge is a point where the impact surface is first discontinuous on one side of the impact point and the second subsurface edge is a point where the
- impact surface is first discontinuous on the other side of the impact point; and the impact subsurface has a cross sectional shape of a portion of a conic section.

The plug tubular system in accordance with the present invention is characterized by comprising:

- a tubular body comprising a housing; and
- a plug assembly comprising a breaker object arranged in a breaker holder, a breaker retainer, and a plug;
- wherein:
  - the plug assembly is arranged with the housing;
  - the plug assembly has a first position where the plug is not in contact with the breaker object and a second position where the plug is in contact with the breaker object;
  - the breaker object is arranged to break the plug in the second position;
  - the breaker object is arranged in the breaker holder; and
  - the breaker retainer is arranged to hold the breaker object in the breaker holder when in the second position.

In accordance with a preferred embodiment of the plug tubular system of the present invention the plug assembly is as described above.

In accordance with another preferred embodiment of the plug tubular system of the present invention the breaker holder is a pocket arranged in the housing.

In accordance with another preferred embodiment of the plug tubular system of the present invention the breaker retainer is a shaped portion of the breaker holder or is a separate component and arranged to be affixed to a portion of the breaker holder.

In accordance with another preferred embodiment of the plug tubular system of the present invention the plug assembly further comprises a breaker assembly, wherein the breaker holder is arranged in the breaker assembly, and wherein the breaker assembly is not part of the tubular body.

In accordance with another preferred embodiment of the plug tubular system of the present invention the breaker holder is at least partially a fluid connection between the inside of the tubular body and the outside of the tubular body.

In accordance with another preferred embodiment of the plug tubular system of the present invention the breaker object is in contact with an object holder, and the object holder provides a fluid seal between the breaker object and the outside of the tubular body.

In accordance with another preferred embodiment of the plug tubular system of the present invention it further comprises an object lock which is arranged to move the breaker object toward, or in contact, with a breaker retainer, wherein the breaker retainer has a smaller diameter than the largest of the breaker object.

In accordance with another preferred embodiment of the plug tubular system of the present invention it further comprises a breaker retainer, wherein the breaker object is arranged at least partially within the breaker retainer and the breaker retainer is arranged in the breaker holder.

In accordance with another preferred embodiment of the plug tubular system of the present invention the plug assembly further comprises a seat to support the plug, the seat further comprises a breaker pocket to allow the breaker object to pass through the seat when the plug assembly moves from the first position to the second position.

In accordance with another preferred embodiment of the plug tubular system of the present invention the tubular body is one continuous piece.

In accordance with another preferred embodiment of the plug tubular system of the present invention the plug assembly further comprises a shear ring arranged such that it breaks at a threshold absolute pressure or pressure differential to move the plug assembly from the first position to the second position, and wherein the shear ring supports the seat.

BRIEF DESCRIPTION OF THE FIGURES

The above and further features of the invention are a set forth with particularity in the appended claims and advantages thereof will become clearer from consideration of the following detailed description. Embodiments of the present invention will now be described, by way of example only, with reference to the following diagrams wherein:

Figure 1A:
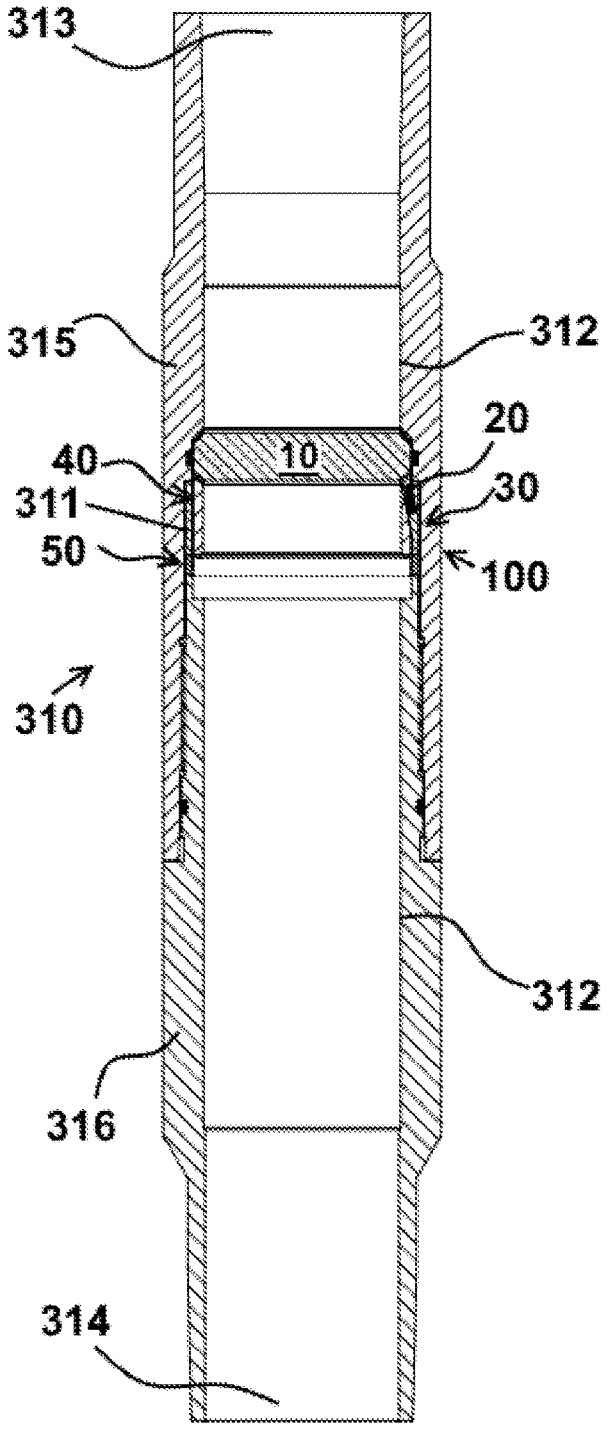
FIGS. 1A-1D disclose the plug tubular during operation in a longitudinal cross-sectional view FIG. 1E discloses an embodiment of the plug tubular FIGS. 2A-2E disclose the impact surface geometry for different breaker objects in different positions in cross section FIGS. 3A and 3B disclose a plug tubular with parabolic breaker objects FIGS. 4A and 4B disclose a plug tubular with pin breaker objects FIGS. 5A and 5B disclose a plug tubular with circular breaker objects FIG. 5C discloses a plug tubular with a breaker object with a circular impact surface FIG. 6 discloses a breaker object mounted directly to the tubular body FIG. 7 discloses a breaker object mounted in a breaker assembly FIGS. 8A and 8B disclose a breaker object that is arranged in the tubular body

| Reference numbers and corresponding elements | | |
|---|---|---|
| 10 | Plug | 10 |
| 11 | Plug Impact Point | 11 |
| 12 | First Plug Edge | 12 |
| 13 | Second Plug Edge | 13 |
| 14 | Plug Impact Section | 14 |
| 15 | Plug Sealer | 15 |
| 20 | Breaker Object | 20 |
| 21 | Impact Section | 21 |
| 211 | Impact Point | 211 |
| 212 | First Breaker Edge | 212 |
| 213 | Second Breaker Edge | 213 |
| 22 | Impact Surface | 22 |
| 24 | Breaker Retainer | 24 |
| 25 | Object Lock | 25 |
| 26 | Sealer | 26 |
| 221 | First Subsurface Edge | 221 |
| 222 | Impact Subsurface | 222 |
| 223 | Second Subsurface Edge | 223 |
| 30 | Breaker Assembly | 30 |
| 31 | Breaker Holder | 31 |
| 40 | Seat | 40 |
| 41 | Bearing Ring | 41 |
| 42 | Breaker Pocket | 42 |
| 50 | Shear Ring | 50 |
| 51 | Shear Ring Body | 51 |
| 52 | Shear Ring Lip | 52 |
| 100 | Plug Assembly | 100 |
| 310 | Plug Tubular | 310 |
| 311 | Housing | 311 |
| 312 | Tubular Body | 312 |
| 313 | Upstream Tubular Connection | 313 |
| 314 | Downstream Tubular Connection | 314 |
| 315 | First Tubular Section | 315 |
| 316 | Second Tubular Section | 316 |

DETAILED DESCRIPTION OF THE INVENTION

Reference will now be made in detail to the present embodiments of the invention, examples of which are illustrated in the accompanying drawings. Alternative embodiments will also be presented. The drawings are intended to be read in conjunction with both the summary, the detailed description, and an any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art.

The present invention is a breaker object that is used to break a frangible plug. This is a part of a plug assembly which is inserted into a tubular in order to allow for a temporary flow barrier through the pipe. More particularly, it is the shape of the breaker object itself which is claimed. There are presented examples of spherical (circular cross section), ellipsoid (ellipse cross section), and paraboloid (parabola cross section) breakers. Most of the figures show 2D cross sections and the shapes of the breaker object will be discussed in terms of the 2D terms (conical shapes) with the 3D terms (conical shapes which have been revolved around an axis) used on occasion.

Reference is made to FIGS. 1A-1E. FIGS. 1A-1D disclose the plug tubular 310 during operation. The plug tubular 310 has an upstream tubular connection 313 and a downstream tubular connection 314. These connections allow for the plug tubular 310 to connect to other tubulars in the work string. There is a fluid connection between upstream tubular connection 313 and downstream tubular connection 314. In the example shown in FIGS. 1A-1D, the plug tubular 310 comprises two tubulars, a first tubular section 315 and a second tubular section 316, which have been affixed together. The bodies of each of these forms the tubular body 312 of the plug tubular 310. A plug assembly 100 is arranged in a housing 311 in the tubular body 312. The plug assembly 100 comprises a frangible plug 10 which is supported by a seat 40. A breaker assembly 30 contains a breaker object 20. The plug assembly 100 is arranged such that when a predetermined threshold pressure differential or absolute pressure is applied to a surface of the plug 10, a shear ring 50 will break. This will bring the plug 10 into contact with the breaker object 20 and initiate the breaking process. This could be because the seat 40 moves and/or because the breaker object 20 moves to make contact. In the examples shown, it is the seat 40 which moves and the breaker object 20 remains stationary. The breaker object 20 shown in FIGS. 1A-1D is a pin type with an elongated body that is at an angle with respect to the axial axis of the plug tubular 310.

Figure 1B:
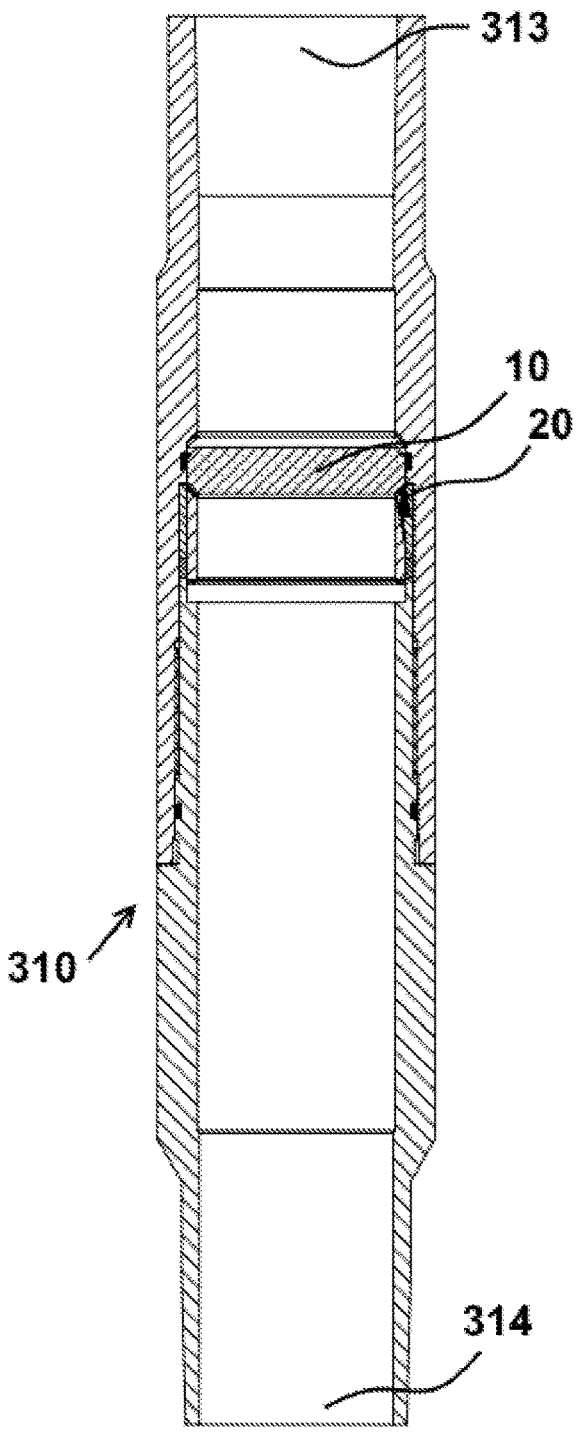
Figure 1C:
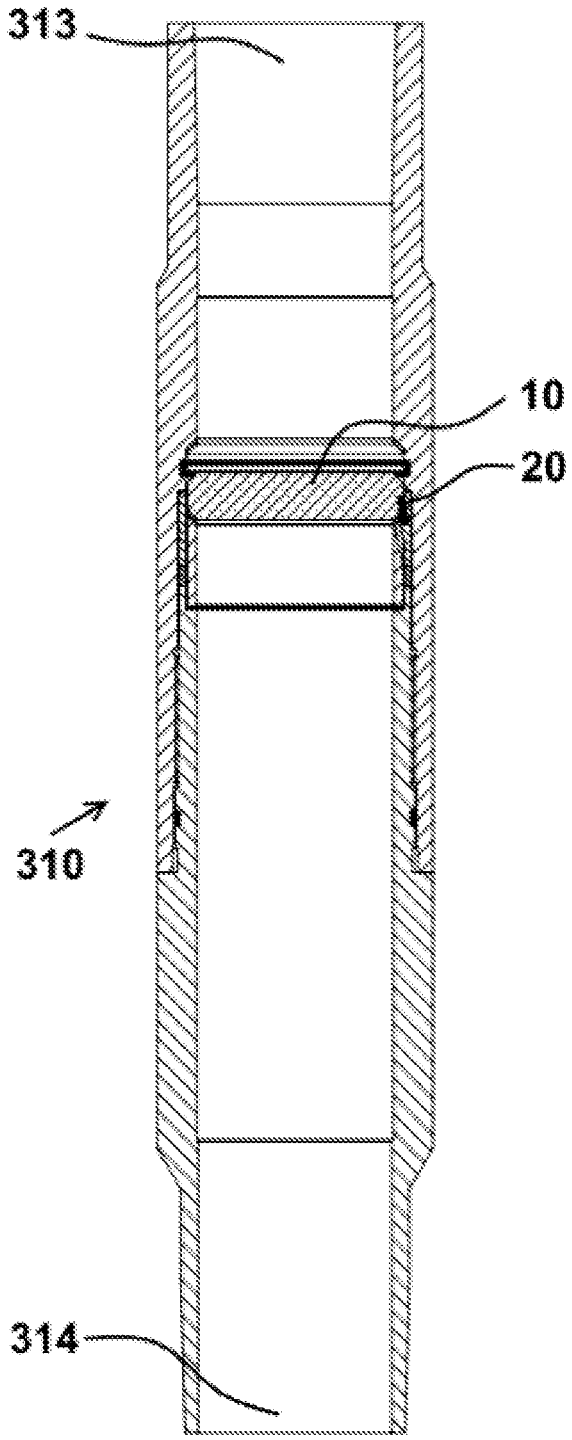
Figure 1D:
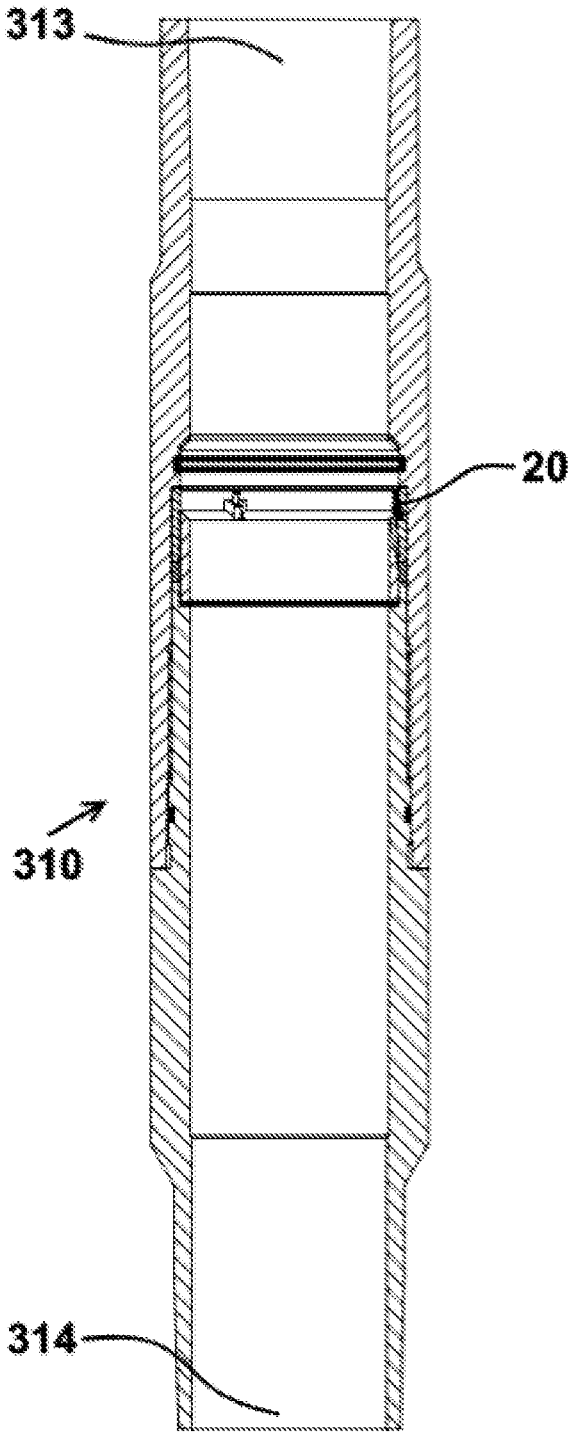

FIG. 1A discloses the first position in which the plug 10 and the breaker object 20 are not in contact. This is the initial state of the system. In this position, the fluid connection between the upstream tubular connection 313 and the downstream tubular connection 314 is blocked by the plug 10. FIG. 1B shows the second position in which the plug 10 has made initial contact with the breaker object 20. This is the start of the breaking process. In this position, there is still no fluid connection between the upstream tubular connection 313 and the downstream tubular connection 314. FIG. 1C shows the behavior of the plug 10 after the second position. The plug 10 will continue to travel and more of the breaker object 20 will be forced into the plug 10. Finally, FIG. 1D discloses the plug 10 as completely broken by the breaker object 20 and the fluid connection between the upstream tubular connection 313 and the downstream tubular connection 314 of the plug tubular 310 is restored.

Figure 1E:
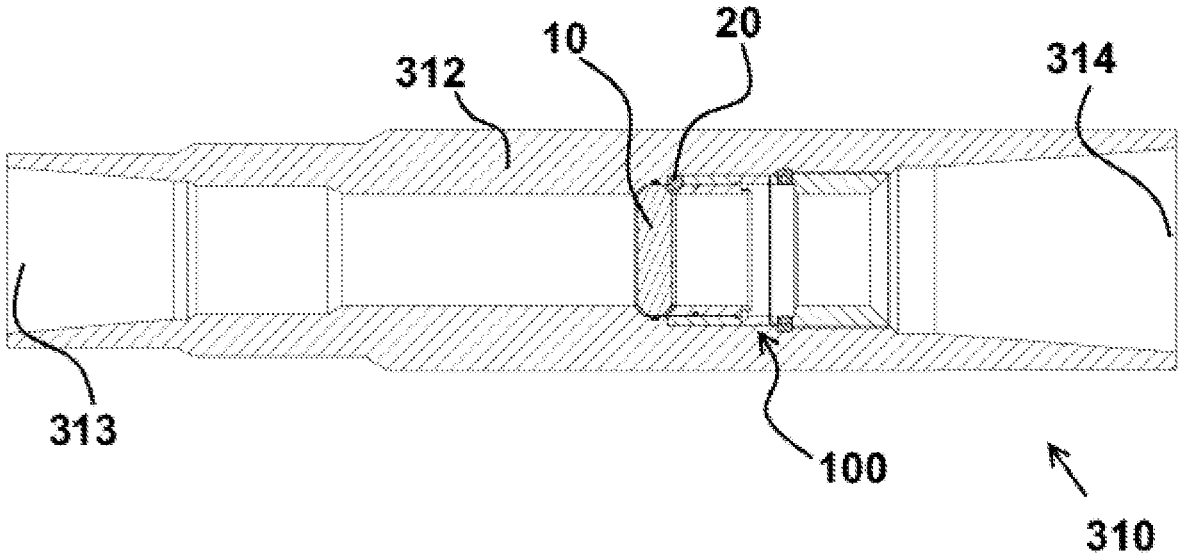

FIG. 1E discloses an embodiment of the tubular 310. In this case the plug assembly 100 is arranged in a tubular body 312 that is different than that of FIGS. 1A-1D. In FIGS. 1A-1D, the tubular body 312 was comprised of a first tubular section 315 and a second tubular section 316. The plug assembly 100 is shown as resting on a portion of the second tubular section 316. However, in FIG. 1E, the tubular body 312 that is between the upstream tubular connection 313 and the downstream tubular connection 314 is made of a single continuous piece. This results in a tubular body 312 that is stronger. Such a tubular body 312 is also less likely to leak because there is no joint between a first tubular section 315 and a second tubular section 316 that requires welds and/or sealing elements.

The position of the plug tubular 310 as being in the first or second position is determined by the status of the plug 10 in the plug assembly 100.

Reference is made to FIGS. 2A-2E. All of these figures use the same reference numbers with the same meanings. FIGS. 2A-2E disclose the impact surface geometry and definitions for different breaker objects 20 in different positions. Note that in FIGS. 2A-2E, the relative sizes of the breaker 20 as compared to the plug 10 are not to scale. These breakers (particularly in FIGS. 2A-2C and 2E) are much larger than the plug 10.

This is done for illustration purposes. The plug 10 is shown without resting upon a seat 40 and the different breaker objects 20 is not shown in any type of breaker assembly 30. As before, this is for illustration purposes. The projection of the plug 10 surface onto the breaker object 20 is the impact surface 22. The figures show that the impact surface 22 is the projection in a longitudinal direction with respect to the tubular 310, but this projection could also be in the transverse direction. This is for the case where the breaker object 20 projects from the housing 311 with the plug 10 moving in an axial (longitudinal) direction when going from the first position to the second position.

Also, FIGS. 2A-2E are shown as 2D cross sections. It is to be understood that these are cross sections of a 3D object. This impact surface 22 has the shape of a portion of a circle. A discussed previously, the more general ellipse would also work.

Figure 2A:
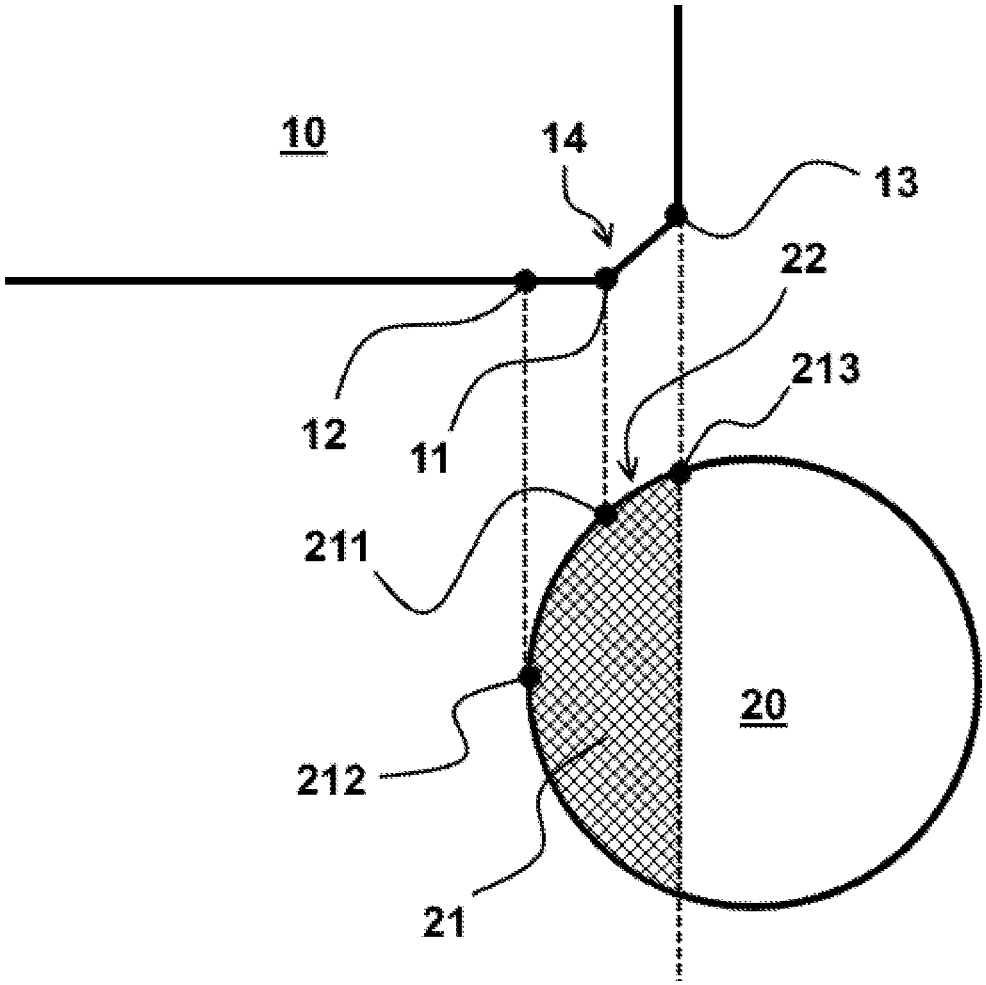

FIG. 2A shows a plug 10 that is not in contact with a breaker object 20. As discussed above, this occurs when the plug has not begun to break. The breaker object is a sphere that is arranged toward the inner wall of the plug tubular 310 (not shown).

Of importance to understanding this invention is to understand the points (in the 2D cross section) where the breaker object 20 and the plug 10 can overlap. The impact section 21 is the portion of the breaker object 20 that is directly underneath the plug 10. The portion of the breaker object 20 that projects into the inner diameter of the plug tubular 310 (not shown) is the first breaker edge 212. During the plug 10 breaking process, this will make contact to the first plug edge 12 of the plug 10. The portion of the plug 10 that is closest to the tubular body 312 (not shown) is the second plug edge 13.

During the plug 10 breaking process, the tubular body 312 makes contact with the second breaker edge 213. The breaker object 20 will first make contact with the plug 10 at the impact point 211. It is preferable that impact point 211 makes a single point of contact in order to maximize the contact force upon the plug 10 to make it break. The plug impact section 14 is the surface of the plug 10 that contains the first plug edge 12 and second plug edge 13 and includes the plug impact point 11. The impact surface 22 is the curve of the breaker object 20 that lies between the first breaker edge 212 and second breaker edge 213 on the surface of the breaker object 20. It should be noted that the impact point 211 is located in between the first breaker edge 212 and the second breaker edge 213.

Figure 2B:
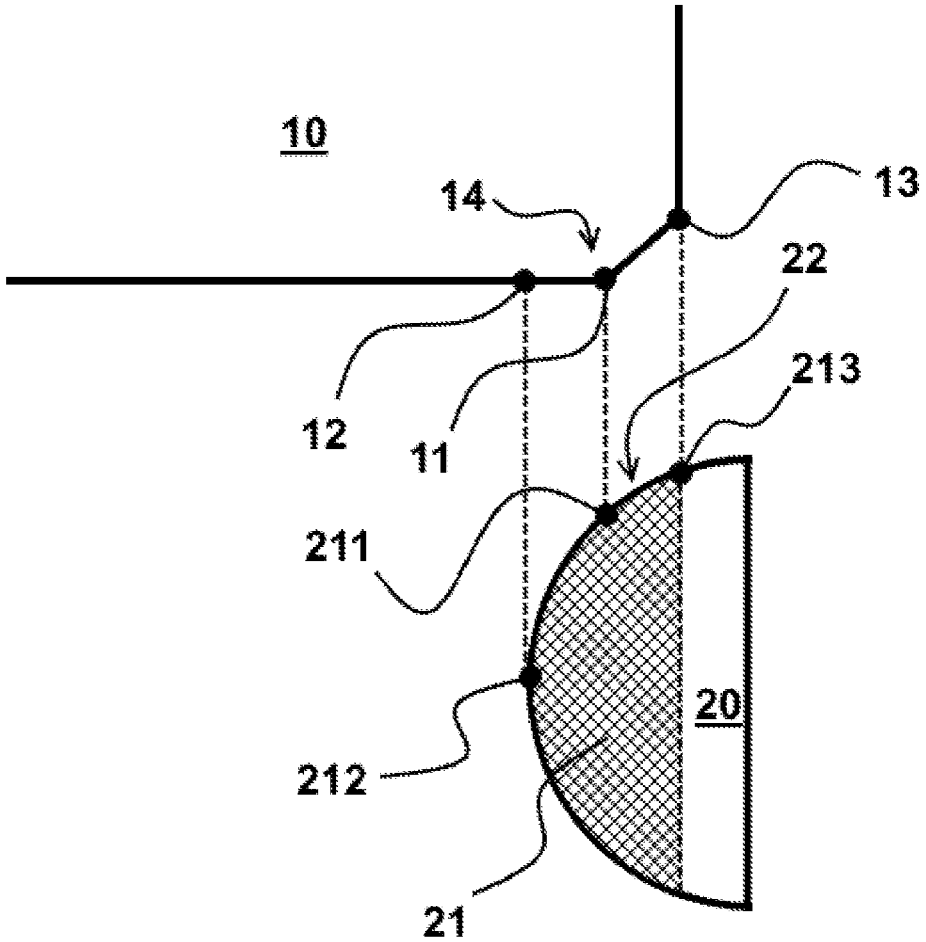

FIG. 2B discloses a hemispheric breaker, but otherwise is the same as shown in FIG. 2A. The impact surface 22 also has the same shape as a portion of a circle.

Figure 2C:
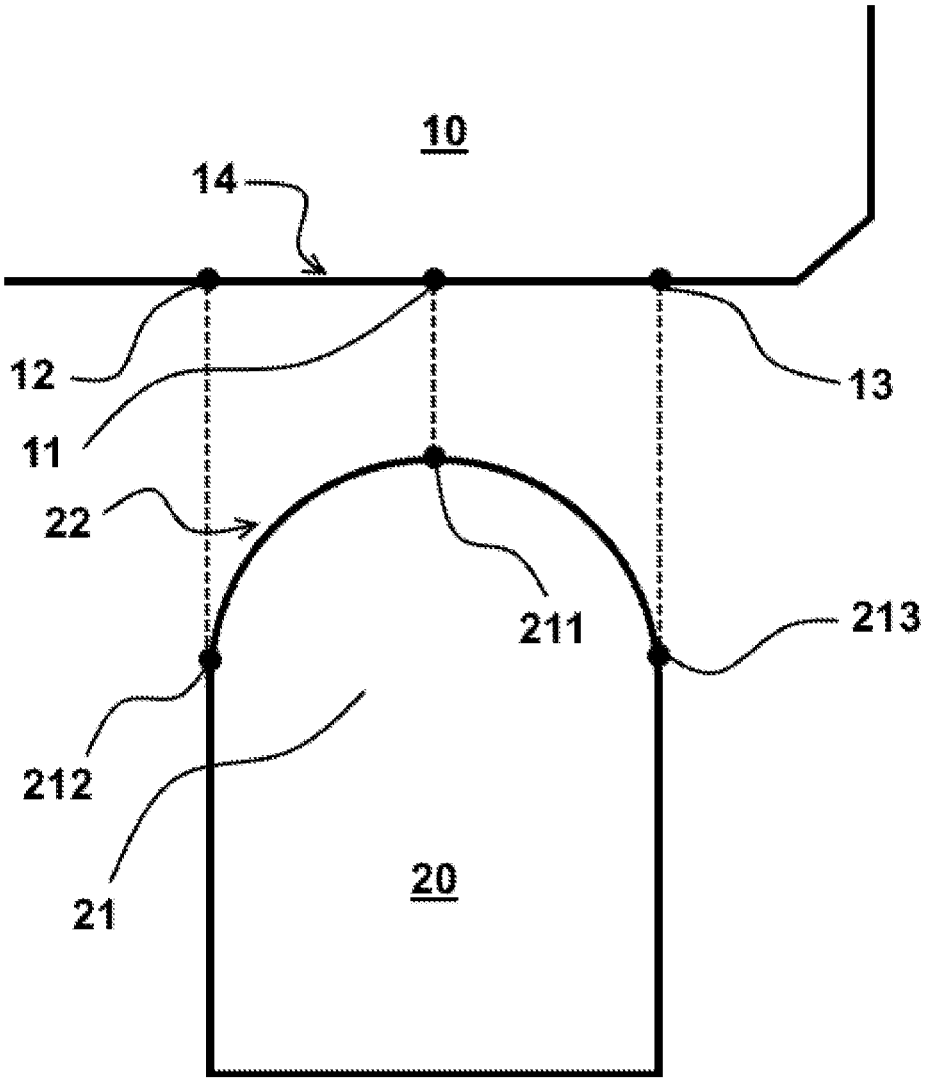

FIG. 2C discloses a pin type breaker object 20 which is arranged so that the second plug edge 13 and second breaker edge 213 are not at the edge of the plug 10. The breaker object 20 in this case is a pin which has an end that is shaped to form the desired impact surface 22 (half circle in this example).

Figure 2D:
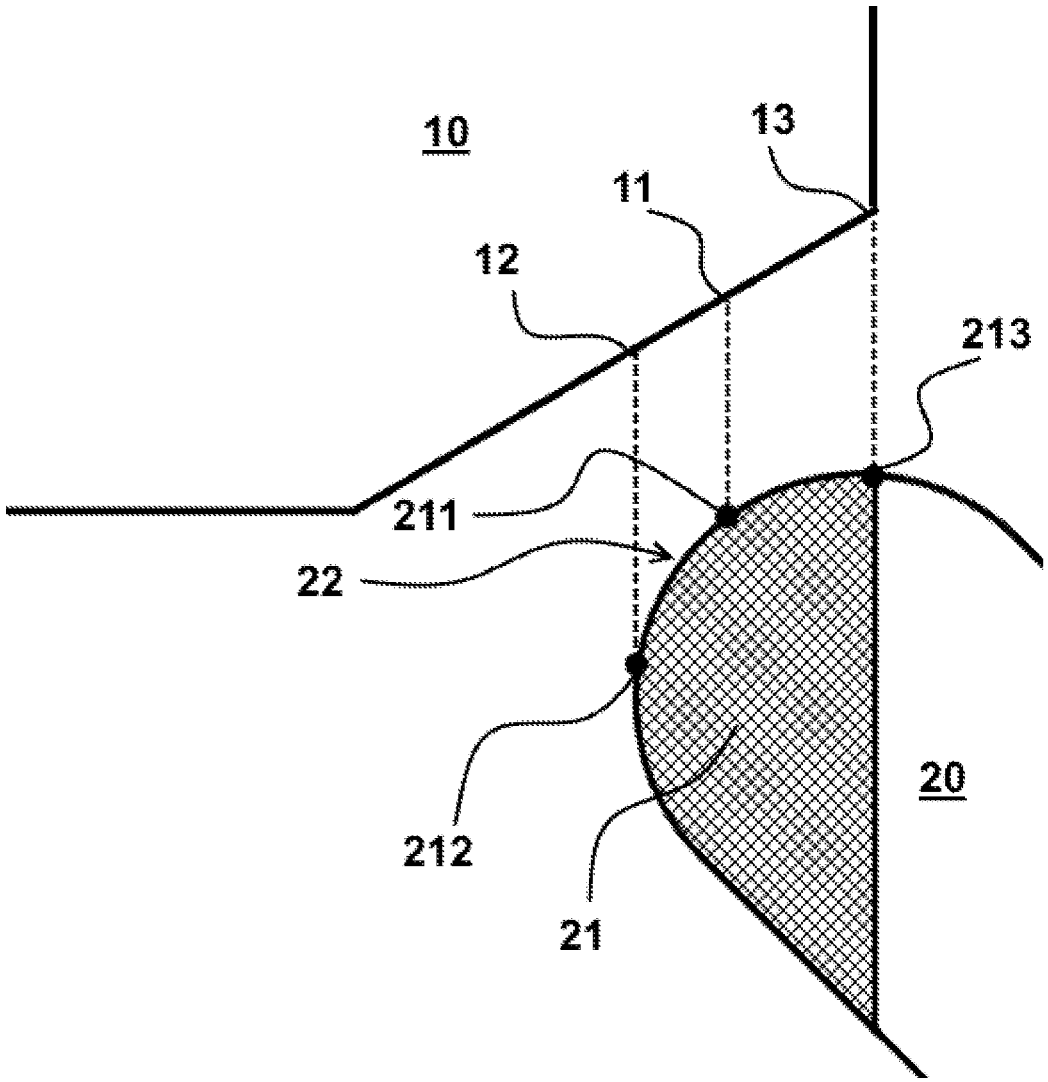

FIG. 2D discloses a pin type breaker object 20 similar to FIG. 2C which is arranged at an angle. While this changes which portion of the breaker object 20 which acts as the impact surface 22, no other modifications to the pin type breaker object 20 is needed. This remain true for any arbitrary angle.

Figure 2E:
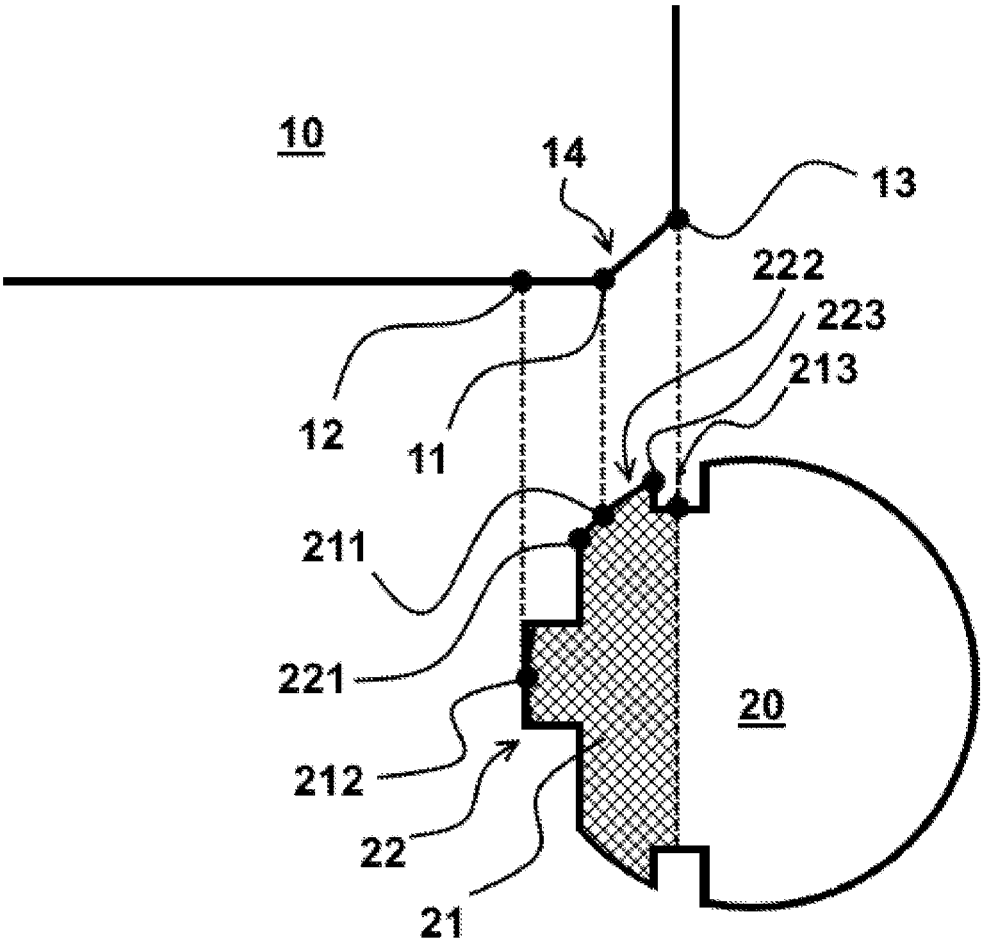

FIG. 2E discloses a spherical breaker object 20 which has had portions of it milled out so that the surface is no longer entirely spherical. Note that it has portions which still have a spherical (circular in FIG. 2E) shape. As in FIGS. 2A-2D, the impact surface 22 is between the first breaker edge 212 and the second breaker edge 213 (and contains the impact point 211). However, in FIG. 2E the impact surface 22 does not have a conic shape. This will be referred to as discontinuous (where continuous is the case where the entire impact surface 22 is a conical shape).

Note that the impact surface 22 is the portion of the plug 10 which faces the breaker object 20. As such, it is not on the opposite side of the breaker object 20. Thus, it is possible for only the impact surface 22 to have the conical shape, and for the other surfaces to not be conical. For example, in FIGS. 2A and 2B, the sphere (or hemisphere) could be flat on the bottom side of the breaker object 20.

As mentioned previously, the breaker object 20 of FIG. 2E has portions of it which are still a conical shape and contain the impact point 211. There is an impact subsurface 222 which is a subsurface of the impact surface 22. The impact subsurface 222 is defined between the first subsurface edge 221 and second subsurface edge 223. These are the end points where the impact surface 22 transitions from continuous to discontinuous and the impact point 211 is located between the first subsurface edge 221 and the second subsurface edge 223.

It is the impact subsurface 222 which has a conical shape (circular in this example). The impact subsurface 222 also contains the impact point 211 (as does the impact surface 22). In this way, a breaker object 20 could be made in a discontinuous shape and still obtain the point contact which is desired on the plug 10 during breaking.

Unlike FIGS. 2A-2E, FIGS. 3A-5C are to scale. Note that the arrangement of the breaker object breaker object 20 and breaker holder 31 as shown in the figures allow for the full restoration of the plug tubular's inner diameter after the plug 10 breaks. This is not a requirement, but it is preferred for most applications. If the arrangement of the housing 311 was different, then there may not be a full restoration of the inner diameter.

Figure 3A:
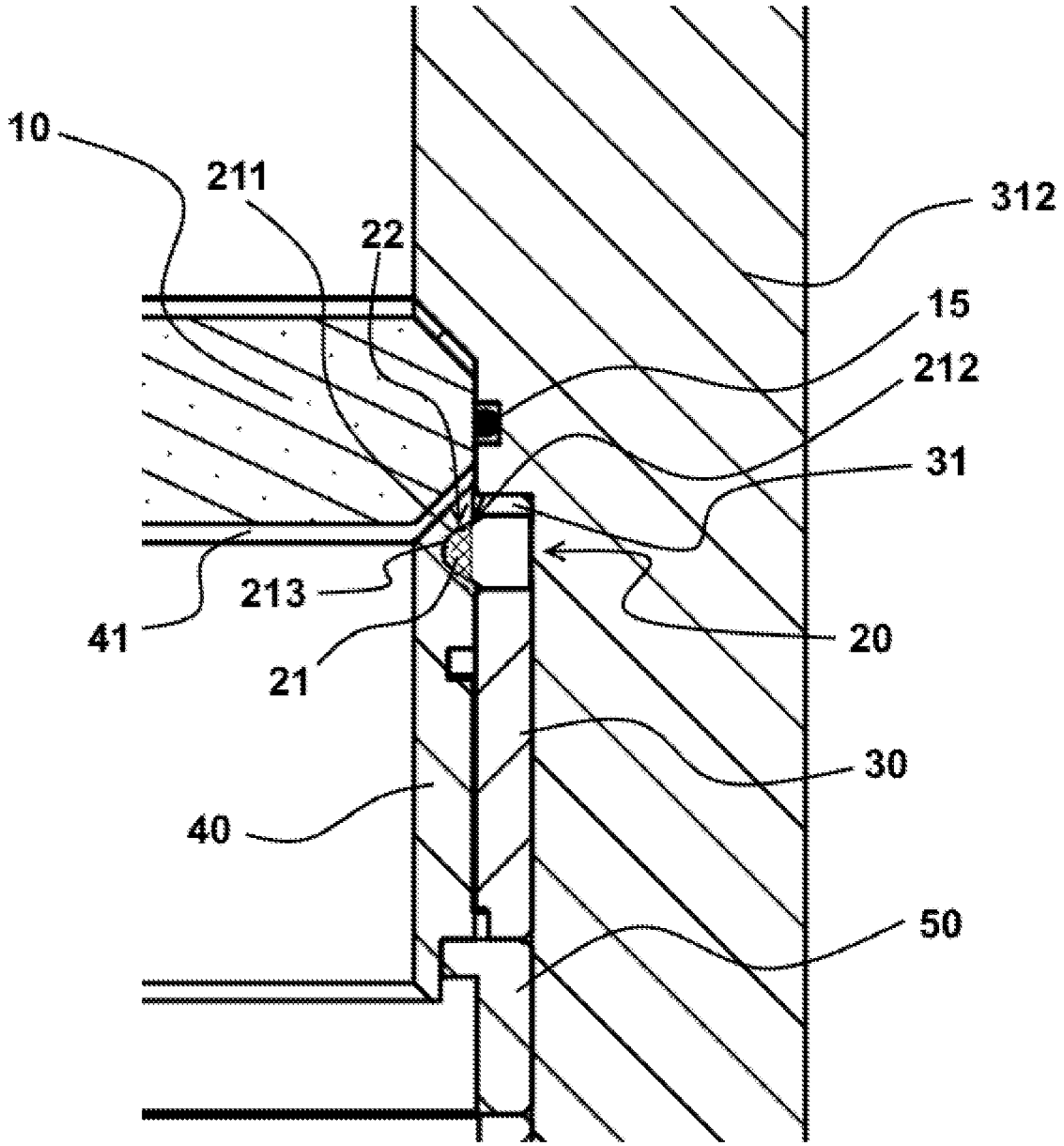
Figure 3B:
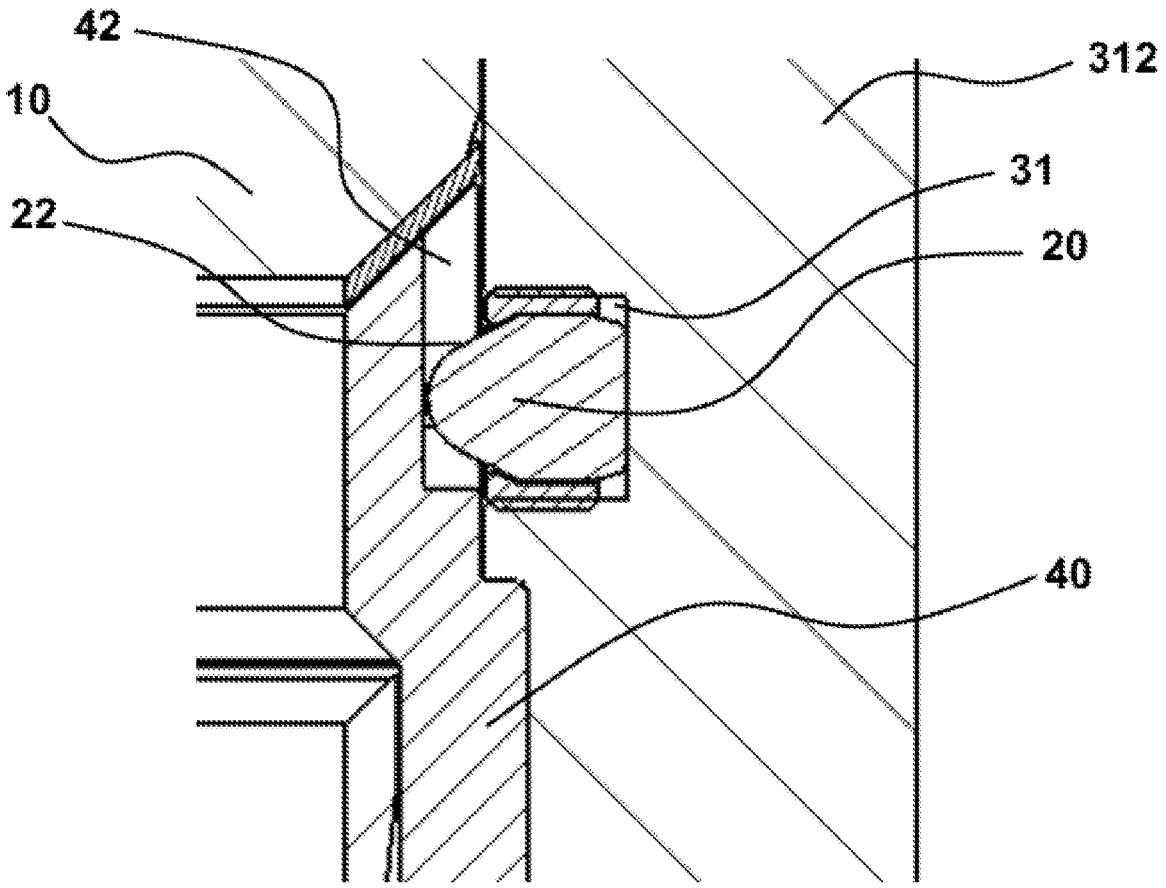

Reference is made to FIGS. 3A and 3B. FIGS. 3A and 3B disclose a plug tubular 310 with a parabolic breaker object 20. It is shown as a portion of a longitudinal cross section view. The plug 10 is shown at a distance from the breaker object 20. The projection of the plug 10 surface onto the breaker object 20 is the impact surface 22. The impact surface 22 contains the impact point 211. The impact point 211 is the portion of the breaker 20 that makes first contact with the plug 10. The impact surface is bounded by the second breaker edge 213 toward the center of the tubular 310 and the first breaker edge 212 toward the edge of the tubular body 312. The seat 40 supports the plug 10 and rests upon the shear ring 50. There is a breaker pocket 42 in the seat 40 which allows for the breaker object 20 to move through the seat 40 when the plug assembly 100 is moving from the first to second position. The breaker assembly 30 is responsible for supporting the breaker object 20 and prevent it from falling into the well during operation. The breaker holder 31 is the portion of the breaker assembly 30 that holds the breaker object 20 in place. It can also be a pocket in the tubular body 312 that contains the breaker object 20. A bearing ring 41 is arranged between the seat 40 and the plug 10. This helps to support the plug 10 and is often made of a soft material. A plug sealer 15 (often an o-ring) helps prevent fluid from going around the plug 10 when the plug 10 moves from the first to the second position.

In the example shown in FIG. 3A, the breaker holder 31 is an opening in breaker assembly 30 that keeps the breaker object 20 in place. In FIG. 3A, the breaker holder 31 is not a portion of a separate breaker assembly 30. Rather it is a pocket in which the breaker object 20 is affixed. Both FIGS. 3A and 3B have a parabolic impact surface 22.

Figure 4A:
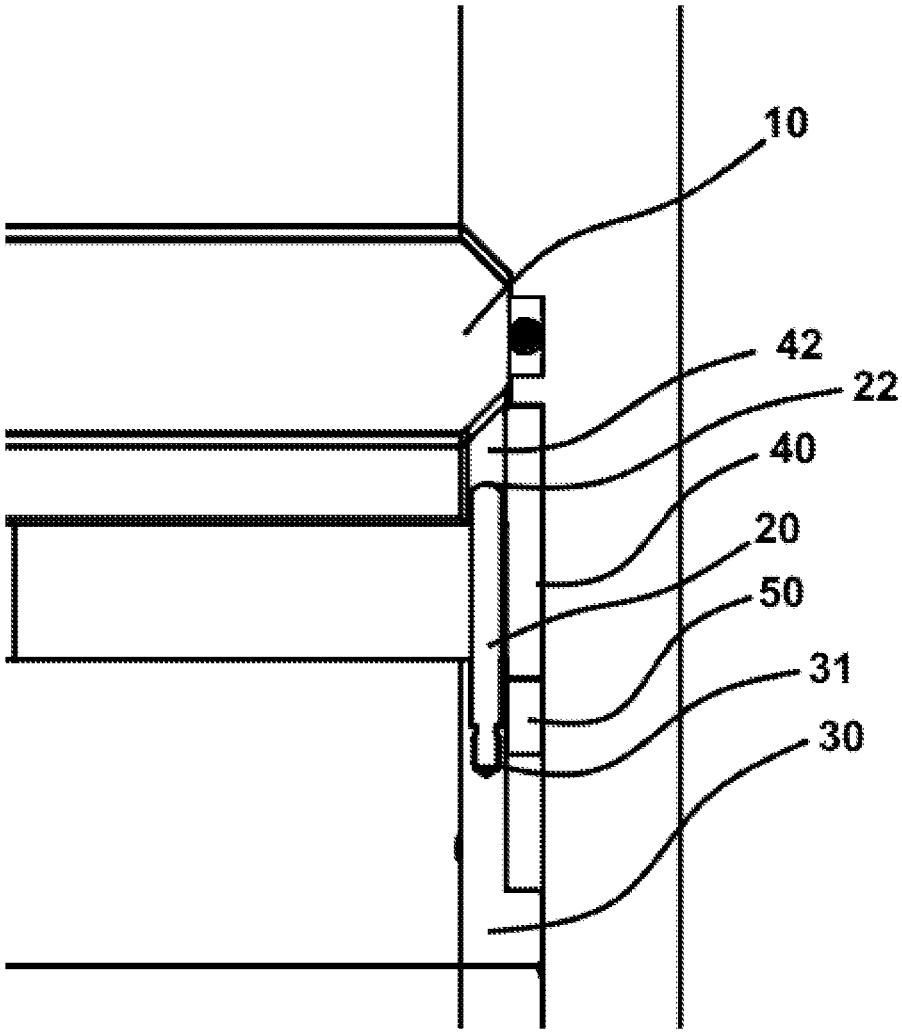
Figure 4B:
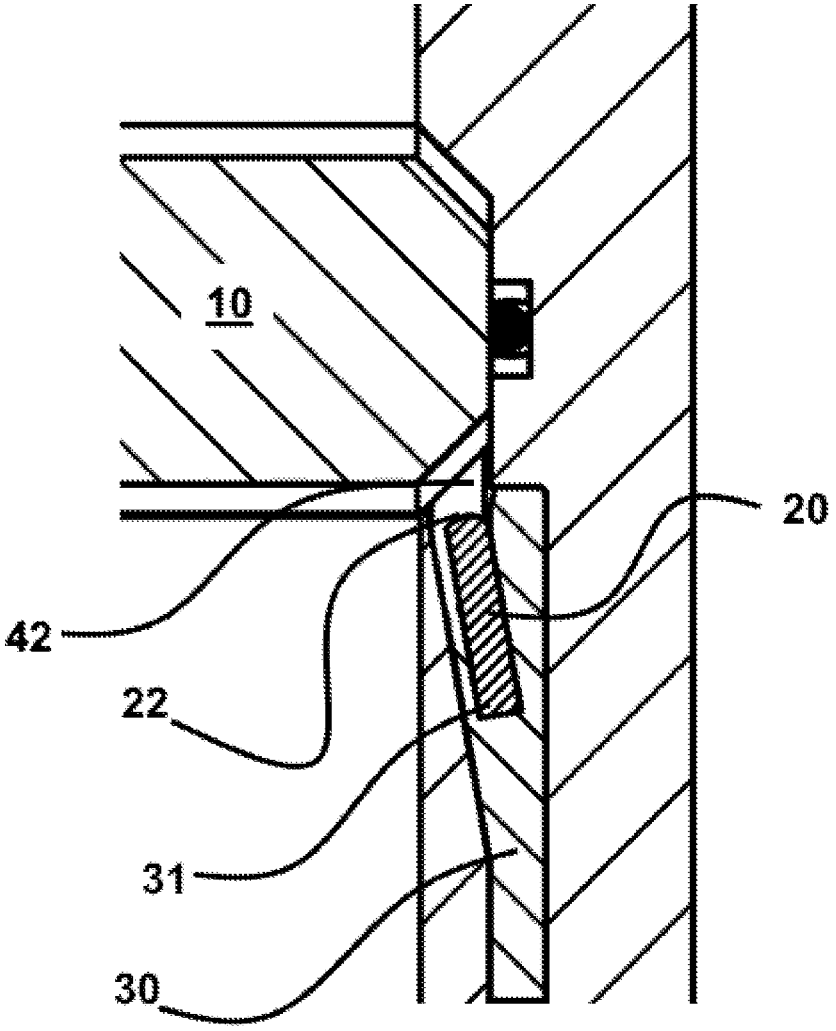

Reference is made to FIGS. 4A and 4B. FIGS. 4A and 4B disclose a plug tubular 310 with a pin breaker object 20. This type of breaker object 20 is characterized by an elongated body with a tip of a conical section. The impact surface 22 of the shown pin breaker object 20 is circular, but the other types of impact surface 22 discussed previously are also possible. The breaker pocket 42 in the seat 40 allows for the breaker object 20 to move through the seat 40 when the plug 10 moves from the first to the second position.

In FIG. 4A, the breaker holder 31 is arranged in the breaker assembly 30 and keeps the breaker object 20 parallel to the axial axis of the plug tubular 310 (not shown). FIG. 4B discloses a similar pin breaker object 20 as that of FIG. 4A. Unlike in FIG. 4A, the breaker holder 31 keeps the breaker object 20 at an angle. The breaker holder 31 is arranged in a breaker assembly 30 which is arranged in a housing 311 in the plug tubular 310 (not shown). As discussed under FIGS. 2C and 2D, there is no need to adjust the shape of the end of the breaker object 20 to match the angle. As the impact surface 22 is a conical surface (circular in this case), it will break the plug 10 through a point contact at the impact surface 22.

Figure 5A:
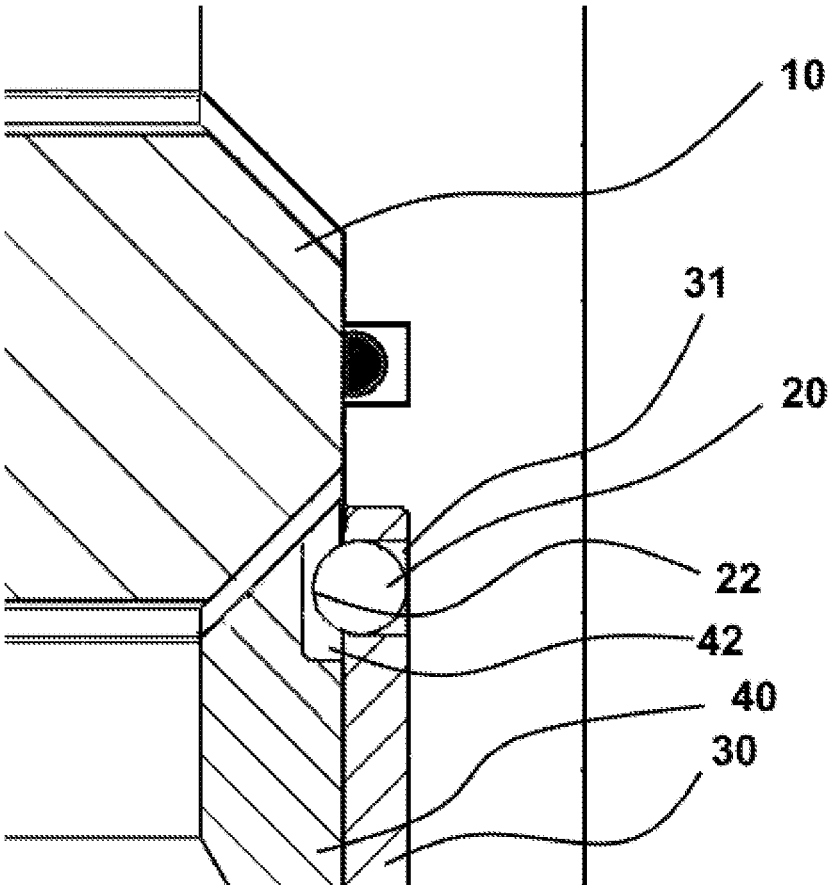
Figure 5B:
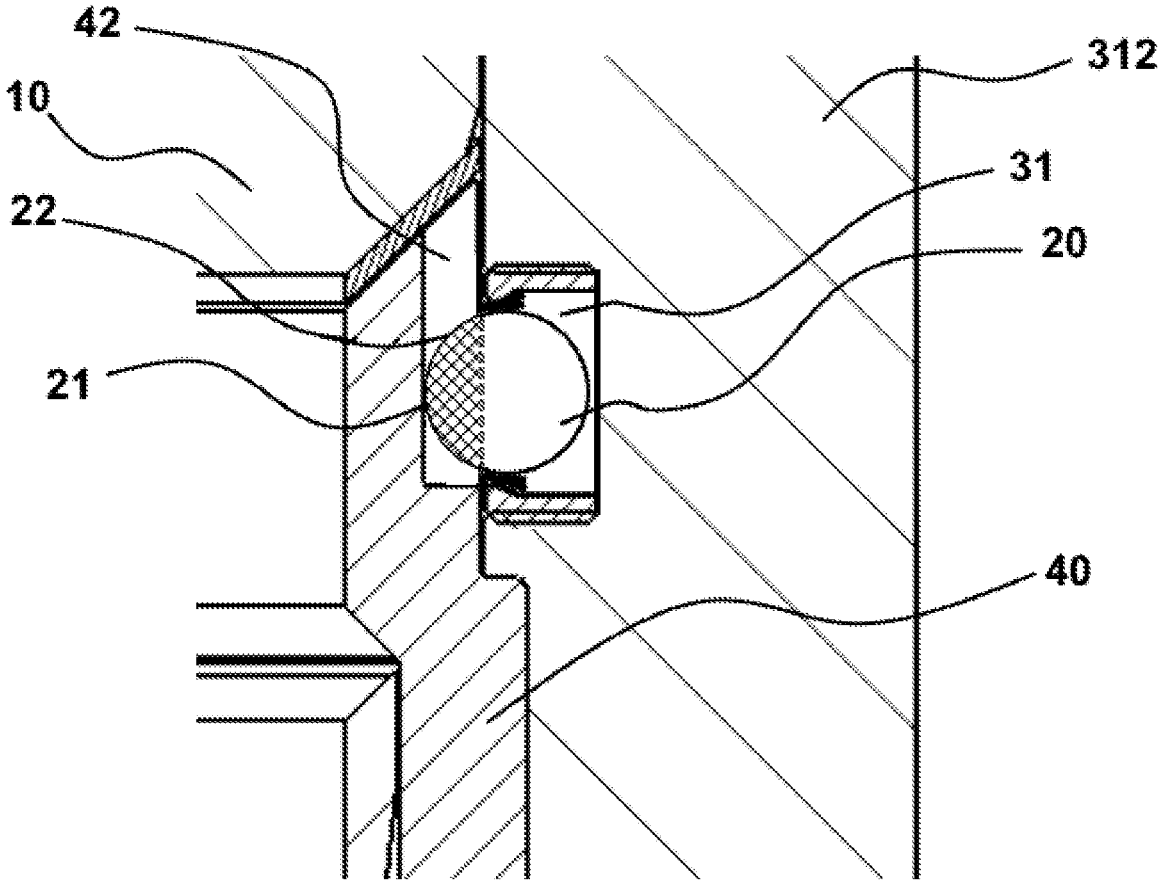
Figure 5C:
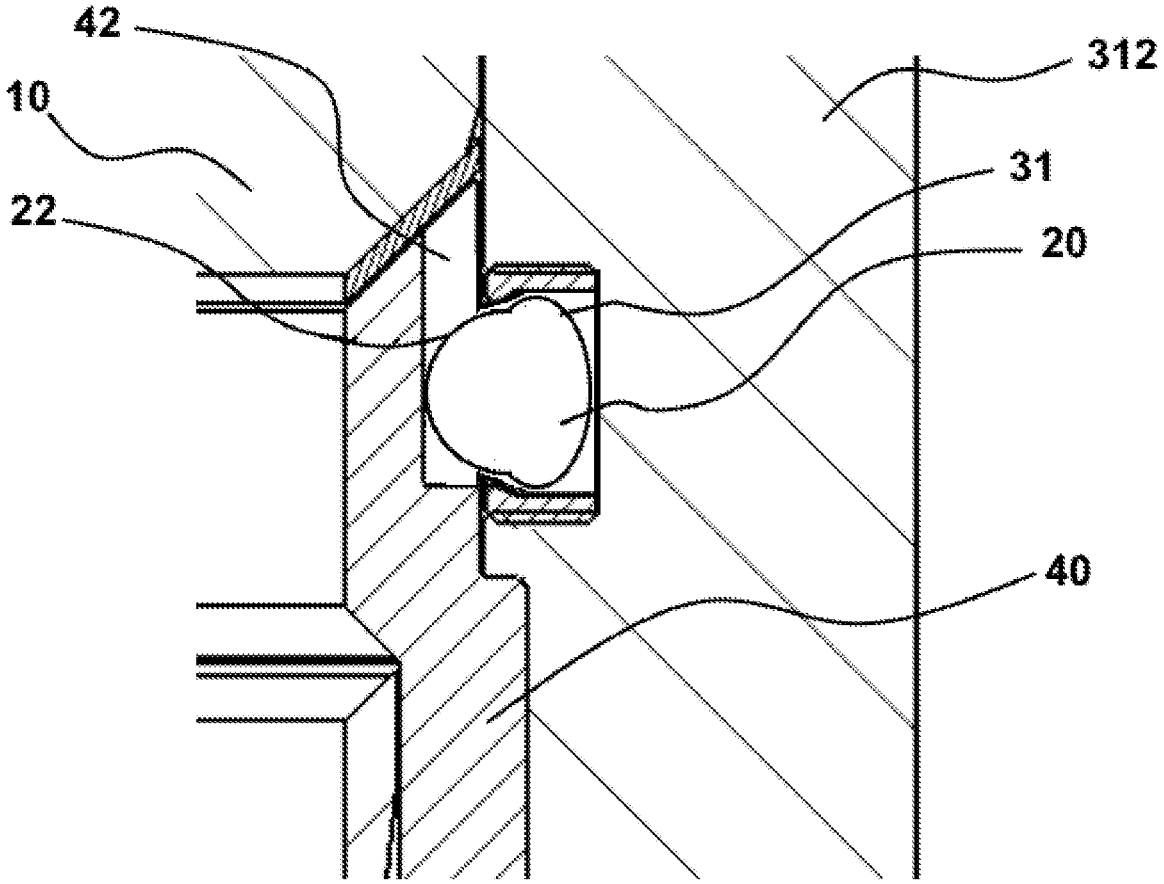

Reference is made to FIGS. 5A-5C. FIGS. 5A-5C disclose a plug tubular 310 with a breaker object 20 that has a circular impact surface 22. In each of these figures, a plug 10 is at a distance from a breaker object 20. The breaker object 20 is arranged in a breaker holder 31. In the case of FIG. 5A, this breaker holder 31 is arranged as part of a breaker assembly 30. There is a breaker pocket 42 in the seat 40 that allows for the breaker object 20 to make contact with the plug 10 when the plug assembly 100 moves from a first position to a second position.

In the case of FIG. 5B, the breaker holder 31 is in a pocket in the tubular body 312. The impact section 21 is shown and is the portion of the breaker object 20 that protrudes from the breaker holder 31. In this arrangement, the circular breaker object 20 is held in the breaker holder 31 in a loose manner. This will be discussed in more detail shortly.

FIG. 5C is the same as FIG. 5B, except for the breaker object 20 has a circular impact surface 22 but has an enlarged portion that is within the breaker holder 31. This allows for more rotational movement when the plug 10 is in contact with the impact section 21 when in the second position. The big backside of the breaker object 20 allows it to rotate more and holds it in place better.

Figure 6:
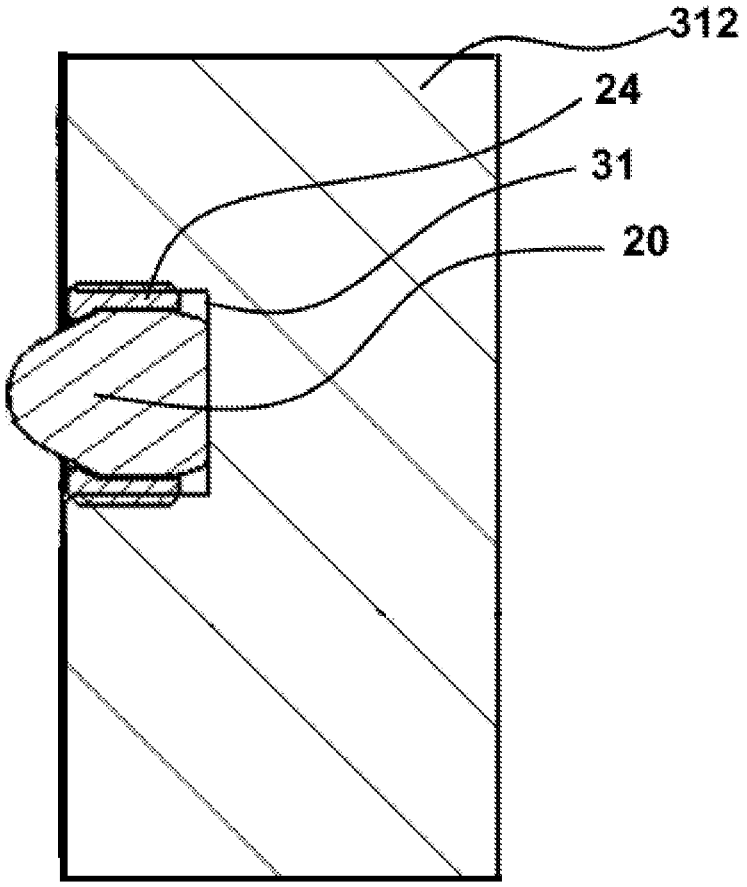

Reference is made to FIG. 6. FIG. 6 discloses a breaker object 20 mounted directly to the tubular body 312. The breaker object 20 is arranged in a breaker holder 31. In particular, the breaker object 20 is arranged in a breaker holder 31 in the tubular body 312. In the figure, there are threads on the outside of the breaker retainer 24 which allow it to be screwed into matching threads on a surface of the breaker holder 31. In the figure, as the breaker retainer 24 is screwed into place in the breaker holder 31, the back of the breaker object 20 makes contact with a portion breaker holder 31. This forces the breaker object 20 into contact with the shoulder of the breaker retainer 24 and holds the breaker object 20 in place. The breaker object 20 could also be held in place using a breaker retainer 24 that would expand to fit into the breaker holder 31. Another way to do this would be to have threads on the breaker object 20 and matching threads in the breaker holder 31. Another way of holding the breaker object 20 in place is that the breaker retainer 24 itself is sufficient to keep the breaker object 20 in place when it is inserted into the breaker holder 31.

Figure 7:
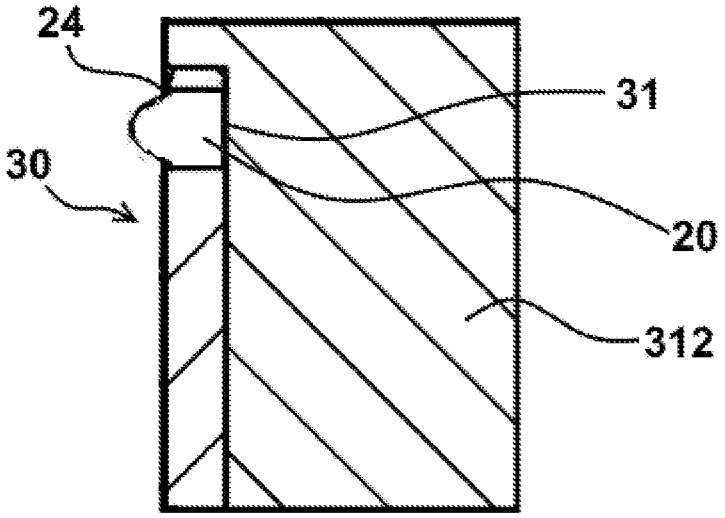

Reference is made to FIG. 7. FIG. 7 discloses a breaker object 20 mounted in a breaker assembly 30. The breaker object 20 is shown with a portion of the breaker object 20 makes contact with a breaker retainer 24. In this case the breaker retainer 24 is a portion of the breaker holder 31. In this manner the breaker object 20 is held in place. In the example shown in FIG. 7, the breaker object 20 does not extend into the tubular body 312. This makes it easier during assembly of the breaker assembly 30 in the plug assembly 100. The object lock 25 is not required in this case because the breaker object 20 was pushed into the breaker retainer 24 to fix the breaker object 20 in place. However, an object lock 25 could be used if needed. The breaker object 20 could be installed either before or after the insertion of the breaker assembly 30 into the housing 311.

Figure 8A:
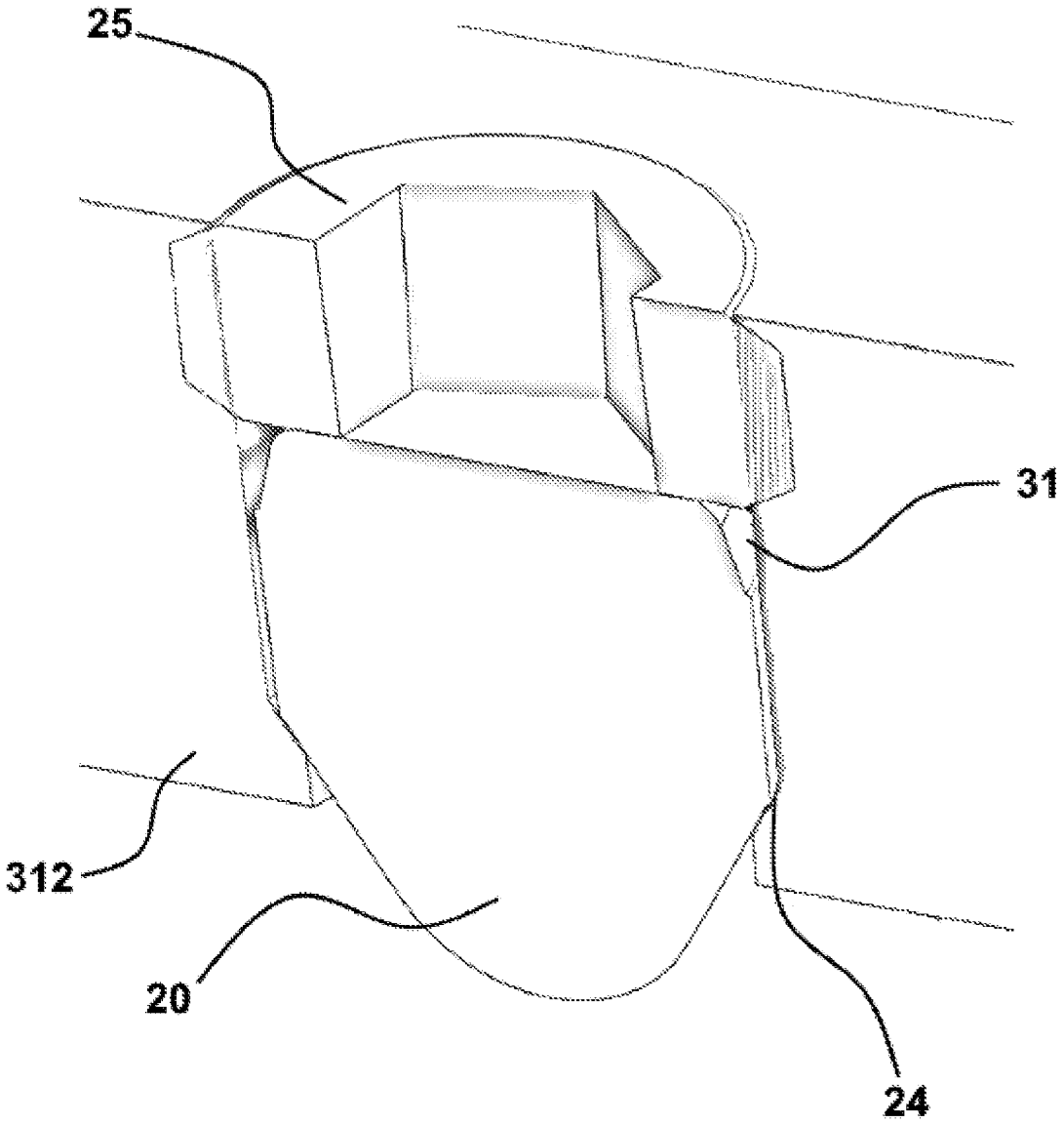
Figure 8B:
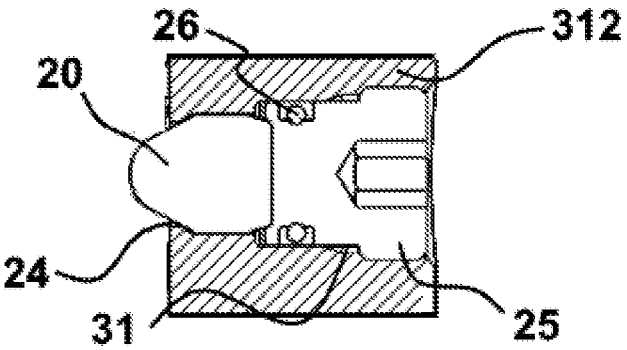

Reference is made to FIGS. 8A and 8B. FIGS. 8A and 8B disclose a breaker object that is arranged in the breaker holder 31. The breaker assembly 30 comprises a through hole in the tubular body 312. Note that this through hole has a shape to it. In this instance, through hole means that there is a fluid connection between the inside of the tubular body 312 and the outside of the tubular body 312. The breaker object 20 is held in place by a breaker retainer 24. The breaker object 20 can be screwed in place using an object lock 25. The object lock 25 could also be arranged to force the breaker object 20 forward until a portion of the breaker object 20 makes contact with the breaker retainer 24. In this case that is a shoulder in the tubular body 312. Another way to hold the breaker object 20 in place is though using threads on the surface of the breaker object 20 and the through hole of the tubular body 312. Another way is to use the same principle as disclosed in the discussion of FIG. 6, wherein the breaker object 20 is put into a breaker retainer 24 before insertion into the tubular body 312.

Shown in FIG. 8B is a different type of object lock 25. This type is not present in FIG. 8A. This object lock 25 provides a fluid seal in the through hole of the tubular body 312. In FIG. 8B, this is accomplished through the use of a sealer 26 around a portion of the object lock 25. The example shown is an O-ring arranged in a groove in the object lock 25. In both FIG. 8A and FIG. 8B the object lock 25 is shown with a slot in it for a hex key to tighten it. However, this is not a requirement. The object lock 25 could be inserted and have a portion of it that locks it in place. It could also have another shape (e.g. Philips head) to be tightened into place.

The object lock 25 shown in the FIGS. 6-8B is threaded on at least part of the outer surface and has a portion in the middle of the outer portion which is adapted to receive a tool that allows for the object lock 25 to be screwed into place. Other methods could also be used. Examples include a portion of the object lock 25, or a separate element, which expands into a portion of the breaker holder 31, housing 311, or tubular body 312. The figures show that the object lock 25 is used to press the breaker object 20 into the breaker retainer 24. However, this is not a requirement. It is possible for there to be a gap between the right portion (as shown in the figures) of the breaker object 20 and the breaker holder 31. In such a case, this allows for a small bit of extra tolerance during assembly and operation of the breaker assembly 30. As long as all of the breaker object 20 is prevented from falling into the internal diameter of the plug tubular 310 when the breaker assembly 30 moves into a position that breaks the plug 10. This is because the breaker retainer 24 is smaller than the largest diameter of the breaker object 20.

A breaker object 20 can be affixed in the plug assembly 100 such that it is fixed and unable to move in the breaker holder 31. One way to do this is to simply insert a screw through the breaker object 20 into the housing 311. Another way to fix the breaker object 20, is to put threads on the outside of the breaker object 20 with corresponding receiving threads in the housing 311.

The breaker object is prevented from entering the inside of the plug tubular 310. In the examples provided in the figures, this is accomplished by having at least a portion of the breaker object 20 in contact with a breaker retainer 24. This breaker retainer 24 can be for example a separate piece or how a portion of the breaker holder 31 is shaped. The object lock 25 is not an essential component. Other components could be used to make a strong connection between the breaker object 20 and the breaker retainer 24 if desired. For example, springs could be used in the breaker holder 31. In other cases, connection between the breaker retainer 24 and the breaker object 20 is sufficient and some rotation of the breaker object 20 is acceptable.

A breaker object 20 can also be held in place in the breaker holder 31 such that it can at least partially rotate and/or translate. This will be referred to as "loosely mounted". This is not to be confused with a state of the plug tubular 310 where the breaker object 20 breaks away from the breaker holder 31 and is now freely moving within the plug tubular 310.

Under a high differential pressure, it is possible for the released plug 10 to be moving with a lot of force. It may be high enough to impact the breaker object 20 hard enough to flatten the impact point 211 on the breaker object 20. The breaker object 20 would still manage to break the plug 10 as intended, but it may take longer or result in larger pieces of the plug 10 than intended after breakage. One possible advantage of a loosely mounted breaker object 20 is that the breaker object 20 may be able to move (by rotation and/or translation) to bring a "fresh" (unflatten) surface into contact with the plug 10. This would result in a cleaner plug 10 break under high pressures.

The sphere is a good shape for a breaker object 20. However, there are advantages to not using a sphere, or other solid 3D ellipsoid shape, as a breaker object 20. By that it is meant that the breaker object 20 has only a portion of it that is a conic section in cross section. For example, it may be easier to affix a hemisphere into the breaker assembly 30, breaker holder 31, or the housing 311. That is because a non-spherical surface makes it easier to keep it in place. Another example is that a pin with an impact surface 22 that has a conical cross section, but is elongated, may be easier to install in a breaker holder 31 and provide a better breaking of the plug 10 if it is moving at a high speed when going from position one to position two (normally due to a high differential pressure across the plug 10).

Please note that "step of" is not to be interpreted as "step for". By "comprised of", "comprising", "comprises" etc. we are referring to an open set and by "consisting of" we are referring to a closed set.

Modifications to the embodiments previously described are possible without departing from the scope of the invention as defined by the accompanying claims. Numerals included within parentheses in the accompanying claims are intended to assist understanding of the claims and should not be construed in any way to limit the subject matter claimed. Reference to the singular is also to be construed as relating to the plural unless expressly stated otherwise. Any reference numbers in the claims are provided as a courtesy and are not to be interpreted as limiting the claim in any way.

It is hereby claimed:

1. A plug tubular (200) system comprising:

a tubular body (312) comprising a housing (311); and a plug assembly (100) comprising a breaker object (20) arranged in a breaker holder (31), a breaker retainer (24), and a plug (10);

wherein:

the plug assembly (100) is arranged with the housing (311);

the plug assembly has a first position where the plug (10) is not in contact with the breaker object (20) and a second position where the plug (10) is in contact with the breaker object (20);

the breaker object (20) is arranged to break the plug (10) in the second position;

the breaker object (20) is arranged in the breaker holder (31); and the breaker retainer (24) is arranged to hold the breaker object (20) in the breaker holder (31) when in the second position, wherein:

the breaker object (20) comprises an impact surface (22), where the impact surface is a projection of the plug (10) surface onto the breaker object (20), wherein the impact surface (22) is a portion of a surface of an ellipsoid, a sphere, or a paraboloid.

2. The system according to claim 1, wherein the assembly (100) further comprises a breaker assembly (30), wherein the breaker holder (31) is arranged on the breaker assembly (30).

3. The system according to claim 2, wherein breaker holder (31) is a pocket arranged in the housing (311).

4. The system according to claim 3, wherein the plug assembly further comprises the breaker assembly (30), wherein the breaker holder (31) is arranged in the breaker assembly (30), and wherein the breaker assembly (30) is not part of the tubular body (312).

5. The system according to claim 1, wherein the breaker retainer (24) is a shaped portion of the breaker holder (31).

6. The system according to claim 1, wherein the breaker retainer (24) is a separate component and arranged to be affixed to a portion of the breaker holder (31).

7. The system according to claim 1, wherein the breaker holder (31) is arranged in a through hole between the inside of the tubular body (312) and the outside of the tubular body.

8. The system according to claim 7, wherein the breaker object (20) is in contact with an object holder (25), and the object holder (25) provides a fluid seal between the breaker object (20) and the outside of the tubular body (312).

9. The system according to claim 1, further comprising:

an object lock (25) which is arranged to move the breaker object (20) toward, or in contact, with the breaker retainer (24), wherein the breaker retainer (24) has a smaller diameter than the largest of the breaker object (20), or a breaker retainer (24), wherein the breaker object (20) is arranged at least partially within the breaker retainer (24) and the breaker retainer is arranged in the breaker holder (31).

10. The system according to claim 1, wherein the impact surface (22) has a second longitudinal cross sectional shape of a portion of a circle or an ellipse or a parabola.

11. The system according to claim 1, wherein the breaker object (20) is a sphere or hemisphere.

12. The system according to claim 1, wherein the breaker object (20) is a pin comprising an elongated body with a distal end, wherein the distal end has a distal longitudinal cross sectional shape of a conic section.

13. The system according to claim 1, wherein the assembly (100) further comprises a breaker assembly (30), wherein the breaker holder (31) is arranged on the breaker assembly (30).

14. The plug assembly (100) according to claim 1, wherein:

the impact surface (22) further comprises an impact point (221) wherein:

the impact point (221) is the portion of the plug (10) which makes contact with the breaker object (20) when the plug assembly (100) is in the second position;

the impact point (211) is contained on an impact subsurface (222), the impact subsurface (222) bounded by a first subsurface edge (221) and a second subsurface edge (223), wherein:

the first subsurface edge (221) is a point where the impact surface (22) is first discontinuous on one side of the impact point (211) and the second subsurface.

15. The system according to claim 1, wherein:

the impact surface (22) further comprises an impact point (221) wherein:

the impact point (221) is the portion of the plug (10) which makes contact with the breaker object (20) when the plug assembly (100) is in the second position;

the impact point (211) is contained on an impact subsurface (222), the impact subsurface (222) bounded by a first subsurface edge (221) and a second subsurface edge (223), wherein:

the first subsurface edge (221) is a point where the impact surface (22) is first discontinuous on one side of the impact point (211) and the second subsurface edge (223) is a point where the impact surface (22) is first discontinuous on the other side of the impact point (221); and the impact subsurface (222) has a subsurface longitudinal cross sectional shape of a portion of a conic section.

* * * * *